US006397853B1

(12) United States Patent
Lovick

(10) Patent No.: US 6,397,853 B1
(45) Date of Patent: Jun. 4, 2002

(54) FILAMENT CLEANING TOOL FOR FINGERNAILS

(76) Inventor: James S. Lovick, 424 Lonestar La., Lindale, TX (US) 75771

( * ) Notice: Subject to any disclaimer, the term of this patent is extended or adjusted under 35 U.S.C. 154(b) by 0 days.

(21) Appl. No.: 09/150,826

(22) Filed: Sep. 10, 1998

(51) Int. Cl.[7] ..... A45D 29/18; A45D 29/04; A61C 15/00

(52) U.S. Cl. ..... 132/76.4; 132/75.6; 132/321

(58) Field of Search ..... 132/76.4, 75.6, 132/73.5, 73, 321, 323, 324, 325, 329, 328, 327, 326

(56) References Cited

U.S. PATENT DOCUMENTS

| | | | | | |
|---|---|---|---|---|---|
| 2,424,509 | A | | 7/1947 | Singer | 15/97 |
| 4,123,816 | A | | 11/1978 | Lupo | 15/21 D |
| 4,137,929 | A | | 2/1979 | Grossman | 134/182 |
| 4,180,884 | A | | 1/1980 | Hess et al. | 15/21 R |
| 4,280,518 | A | * | 7/1981 | Gambaro | 132/323 |
| 4,289,152 | A | | 9/1981 | Fuhre | 132/74.5 |
| 4,635,656 | A | | 1/1987 | Daniel | 132/75 |
| D289,345 | S | | 4/1987 | Fine | D4/119 |
| 4,742,836 | A | | 5/1988 | Buehler | 134/182 |
| 5,069,233 | A | * | 12/1991 | Ritter | 132/322 |
| 5,090,427 | A | | 2/1992 | Sherts | 132/75.6 |
| 5,101,843 | A | * | 4/1992 | Peng | 132/323 |
| 5,433,226 | A | * | 7/1995 | Burch | 132/321 |
| 5,435,033 | A | * | 7/1995 | Millner | 15/22.1 |
| 5,454,386 | A | * | 10/1995 | Dix | 132/323 |
| 5,477,871 | A | * | 12/1995 | Sanchez, Jr. | 132/323 |
| 5,640,979 | A | | 6/1997 | Trenary | 132/73.6 |
| 5,713,378 | A | | 2/1998 | Smith | 132/74.5 |
| 5,775,346 | A | * | 7/1998 | Szyszkowski | 132/329 |
| 5,810,021 | A | * | 9/1998 | Walker | 132/74.5 |
| 5,823,203 | A | * | 10/1998 | Carroll et al. | 132/200 |
| 5,857,471 | A | * | 1/1999 | Harada | 132/321 |
| 5,893,379 | A | * | 4/1999 | Ghamaty-Azimi | 132/323 |

* cited by examiner

*Primary Examiner*—John J. Wilson
*Assistant Examiner*—Robyn Kieu Doan
(74) *Attorney, Agent, or Firm*—John D. Gugliotta

(57) ABSTRACT

Disclosed is a filament cleaning tool for fingernails wherein a length of flexible cleaning filament connected at each end to a small rigid securing ring. Inserted beneath the fingernail, the cleaning filament contains a series of bristles, flays or scale-like protrusions, positioned along its length, that remove dirt, grease and grime from beneath the fingernail as it is drawn back and forth therein.

4 Claims, 4 Drawing Sheets

FILAMENT CLEANING TOOL FOR FINGERNAILS

BACKGROUND OF THE INVENTION

1. Field of the Invention

The present invention relates generally to devices used to clean the area beneath one's fingernails, and more specifically to a fingernail cleaning device that provides for enhanced cleaning by incorporating a special filament that is manually inserted beneath and drawn along the fingernail edge in order to remove highly concentrated, deeply impacted and difficult to remove dirt, grease and grime typically experienced by those such as mechanics, machinists, factory workers or others that work in extremely dirty and greasy environments.

2. Description of the Related Art

Proper grooming and manicuring principles dictate that one must maintain a neat and clean appearance around and under one's fingernails. In particular, when referring to the cleaning and removal of dirt from underneath one's nails, a scraping instrument such as a knife, pointed end of a file or other like sharpened implement is used to accomplish the removal of the bulk of the dirt and debris deposited therein. This process may or may not be either preceded or followed by cleansing with soap and/or water. For the most part, when speaking in terms of the average person, this practice is sufficient to provide adequate cleansing of the area beneath the fingernail. However, in the case of mechanics, machinists, factory workers and others that work in extremely dirty and greasy environments on a hands-on basis require a more thorough and rigorous cleaning in order to clean their hands and, especially, beneath their fingernails. A search of the prior art did not disclose any patents that read directly on the claims of the instant invention. However, several references depicting fingernail cleaning devices were considered related. In general, these devices are far more complex in design than the present invention and many are directed toward automated, non-portable devices incorporating the use of a variety of electro-mechanical systems to complete the task. Lacking the simplicity transportability of the present invention, these devices neither anticipate nor disclose any embodiment that would preclude its novelty and the utilitarian functionality of its features.

U.S. Pat. No. 5,713,378, issued in the name of Smith, discloses an automated fingernail cleaning device in which the user's finger is enclosed in a protective shroud that houses a spray nozzle. The nozzle is connected to a base pumping unit that delivers pressurized water, cleaning the dirt and debris from under the nail.

U.S. Pat. No. 4,635,656, issued in the name of Daniel, discloses a fingernail cleaning device that attaches to a conventional sink spigot. The device includes an orifice disc for projecting a narrow, high velocity jet of water that is housed in a cylindrical, tubular housing. The user inserts his/her finger into the housing and the fingernail is cleaned by the water jet.

U.S. Pat. No. 4,137,929, issued in the name of Grossman, discloses a fingernail cleaning device consisting of an open receptacle capable of receiving a plurality of fingers. The device also consists of a plurality of jets whose source of water requires either a normal hydrant with sufficient pressure, or a pulsating pump motor.

U.S. Pat. No. 4,289,152, issued in the name of Fuhre, discloses a fingernail cleaning apparatus consisting of a large housing with a finger-sized aperture into which a finger is inserted. The apparatus utilizes an electric motor for operating a water-discharging pump which in turn projects pressurized water against the inside surface of the fingernail.

U.S. Pat. No. 4,742,836, issued in the name of Buehler, discloses a fingernail cleaning device whereby all the fingernails on the user's hand can be rapidly and effectively cleaned at one time. The device consists of an open-topped receptacle for enabling the fingers of one hand of the user to be placed therein. Positioned at an angle to the base of the receptacle is a small diameter fluid passageway. Such passageway directs water at a downward angle to the upper surface of the receptacle base thereby creating a high-velocity, fan-shaped stream of water which travels along the bottom of the receptacle in the direction of the fingernails of the user.

All of these devices depart substantially from the spirit, functionality and design of the present invention. Aside from the fact that they all incorporate a different cleansing medium to complete the desired purpose, they are all excessively large, bulky and lack the transportability of the present invention. Furthermore, these devices require connection to an electrical wall socket, to a water supply or both.

U.S. Pat. No. 5,640,979, issued in the name of Trenary, discloses an automated fingernail cleaning device which utilizes a rotating brush, actuated by an electric motor and housed within a protective shield into which the user's finger is placed.

U.S. Pat. No. 4,180,884, issued in the name of Hess et al., discloses an automated fingernail cleaning apparatus which utilizes a disc-shaped rotary brush to obtain effective cleaning action for the fingernails. The rotary brush, which is mounted inside a housing, is driven by an electric motor. The apparatus is capable of cleaning all of the fingers on one hand simultaneously.

U.S. Pat. No. 4,123,816, issued in the name of Lupo, discloses an automated fingernail cleaning apparatus which utilizes a rotating bristle brush for the cleaning of one's fingernails. The rotating bristle brush is connected to a drive shaft, which in turn is actuated by an electric motor.

These devices, as well, depart substantially from the spirit, functionality and design of the present invention. Aside from the fact that they all incorporate a different cleansing medium to complete the desired purpose, they are all excessively large, bulky and lack the transportability of the present invention. Furthermore, these devices require connection to an electrical wall socket or the incorporation of a battery pack in order to supply the required electrical energy.

U.S. Pat. No. 2,424,509, issued in the name of Singer, discloses a fingernail cleaning device which consists of a plurality of upwardly opened, rubber sockets into which a finger is inserted. By engaging in a rotary motion, the wall of each socket will impart a thorough scrubbing to the finger. The rotation of each socket can be actuated either by mechanical operation, via hand crank, or by the operation of a mountable electric motor. The device is limited in that it targets the finger and not the fingernail for cleansing and thus provides a little, if any, effective nail cleaning.

U.S. Pat. No. 5,090,427, issued in the name of Sherts, discloses a finger groomer attachment for a writing instrument. The apparatus performs a variety of manicure operations which are accomplished through the incorporation of various multi-functioning devices. One such device is a fingernail cleaner. Because the fingernail cleaner is thin and pointed, it enables a user to scrape underneath a fingernail to remove dirt and foreign matter. The apparatus is unlike the present invention in that it utilizes a solid, pointed scraping implement rather than a cleaning filament to clean underneath one's fingernails.

U.S. Pat. No. Des. 289,345, issued in the name of Fine, discloses an ornamental design for a fingernail cleaner brush. The device consists of a base portion with bristles embedded therein. Because the device utilizes the bristles of a brush rather than a cleaning it provides a very limited margin of effective cleaning under one's fingernails.

While several features exhibited within these references may be incorporated into this invention, alone and in combination with other elements, the present invention is sufficiently different so as to make it distinguishable over the prior art.

SUMMARY OF THE INVENTION

The filament cleaning tool for fingernails, according the preferred embodiment of the present invention, consists of a length of flexible cleaning filament connected at each end to a small rigid securing ring. Constructed of stainless steel, plastic, nylon or other like suitable materials, the cleaning filament is of a light gauge yet, due to the material construction, is strong, durable, waterproof and easy to clean. The construction of the cleaning filament is such that a series of bristles, flays or scale-like protrusions are positioned along its length. Used in conjunction with soap and water, the user first washes his or her hands thoroughly. Leaving the hands and fingers lathered, the user places one securing ring on the thumb and one on the forefinger of the same hand. Drawing the cleaning filament taut, the use then inserts the cleaning filament underneath the fingernail of a single finger on the hand opposite the hand used to support the tool and draws the filament in a back and forth motion along the nail, adjusting the depth so as to cover the entire surface area thereof. Intended primarily for use by those with large amounts of impacted dirt, grease and grime beneath their nails, the bristles, scales or flays, in conjunction with the soap lather will remove even the most stubborn deposits. The user repeats this procedure for each finger, switching hands in order to cover the fingers on both the right and left hand, and rinses the dirt and grime from the tool when finished. The simple design of the fingernail cleaning filament tool, in conjunction with its size, material construction and ease of use makes it the ideal method by which to clean one's nails.

It is therefore an object of the present invention to provide a filament cleaning tool for fingernails that incorporates the use of a flexible cleaning filament to remove dirt, grease and grime from beneath one's fingernails.

It is another object of the present invention to provide a filament cleaning tool for fingernails wherein the cleaning filament includes a plurality of flays, bristles, scales or other like protrusions or configurations that will aid in the efficient removal of dirt, grease and grime from beneath one's fingernails.

It is another object of the present invention to provide a filament cleaning tool for fingernails wherein its use in conjunction with soap and lather will allow even the most stubborn or impacted dirt, grease and grime to be removed from beneath one's fingernails.

It is another object of the present invention to provide a filament cleaning tool for fingernails small, compact and easy to use.

Finally, It is an object of the present invention to provide a filament cleaning tool for fingernails that is simple in construction and makes use of materials that are strong, durable and cost-effective to manufacture.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

10 Filament Cleaning Tool For Fingernails
11 Securing Rings
12 Cleaning Filament
13 Filament Securing Aperture
15 Flayed Cleaning Filament
16 Flayed Filament Body
17 Flays
20 Bristled Cleaning Filament
21 Bristled Filament Body
22 Bristles
25 Scaled Cleaning Filament
26 Scaled Filament Body
27 Scales
30 Hand
31 Thumb
32 Forefinger
33 Fingernail
35 Handle

DESCRIPTION OF THE PREFERRED EMBODIMENTS

1. Detailed Description of the Figures

Figure 1:
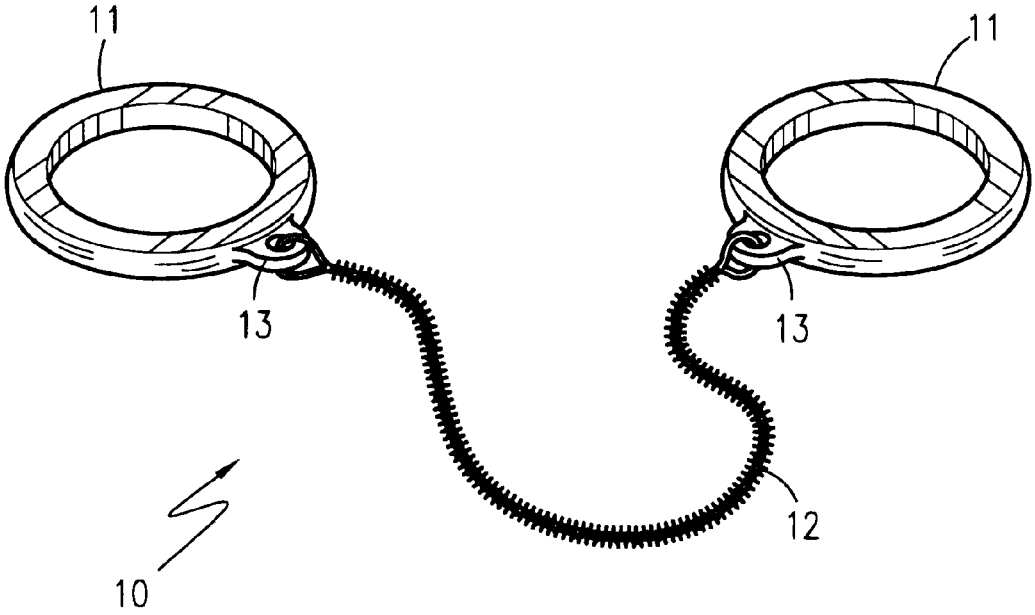
FIG. 1 is a front view of the filament cleaning tool for fingernails, according to the preferred embodiment of the present invention.

Referring now to FIG. 1, depicted is a filament cleaning tool for fingernails, hereinafter cleaning tool 10, according to the preferred embodiment of the present invention. The cleaning tool 10 consists of a pair of securing rings 11 with a cleaning filament 12 connected thereto and spanning therebetween. The securing rings 11 are rigid in nature, constructed of metal, plastic or other materials of like qualities and are waterproof so as to withstand prolonged use. Each securing ring 11 has a filament securing aperture 13, protruding from the edge thereof, that is used to secure the cleaning filament 12 to the securing ring 11. In the preferred embodiment, the filament securing aperture 13 consists of a nipple-type protrusion with a cylindrical aperture of a diameter slightly larger than that of the cleaning filament 12 bored therethrough. The cleaning filament 12 is passed through the filament securing aperture 13 and tied in a knot, thus securing it for use. It is envisioned, however, that a variety of methods exist that can be used to attach the cleaning filament 12 to the securing ring 11. By way of example and not of limitation, the cleaning filament 12 could be secured by tying it directly around the securing ring 11 or a tangential slot could be cut into the body of the securing ring 11 itself, allowing the cleaning filament 12 to be inserted therein and held secured by a friction fit.

Figure 2:
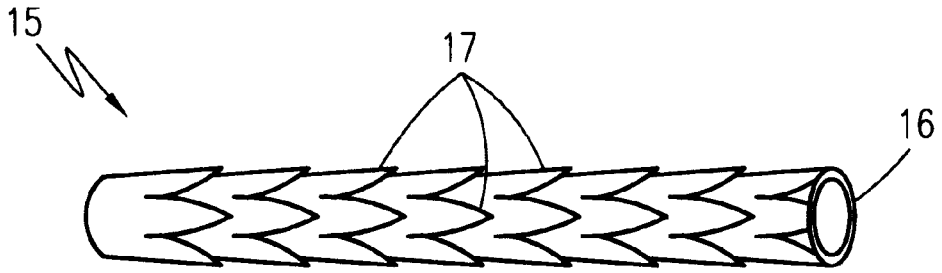
FIG. 2 is a magnified view of a segment of a flayed cleaning filament for use in conjunction with the filament cleaning tool for fingernails, according to the preferred embodiment of the present invention.
Figure 3:
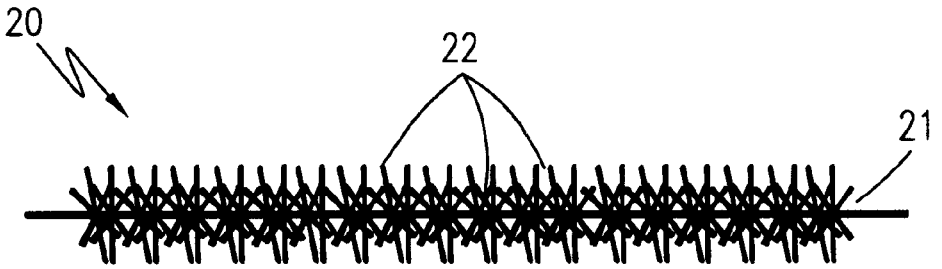
FIG. 3 is a magnified view of a segment of a bristled cleaning filament for use in conjunction with the filament cleaning tool for fingernails, according to the preferred embodiment of the present invention.
Figure 4:
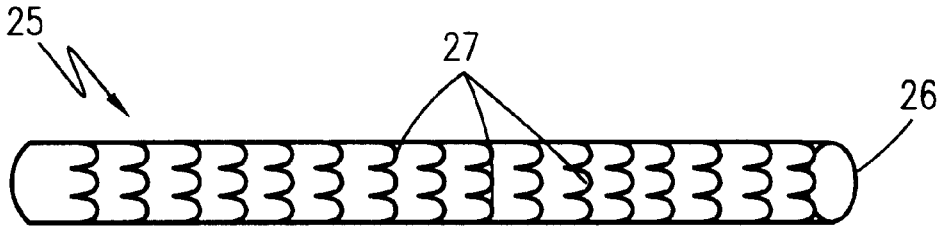
FIG. 4 is a magnified view of a segment of a scaled cleaning filament for use in conjunction with the filament cleaning tool for fingernails, according to the preferred embodiment of the present invention.

Referring now to FIGS. 2–4, a variety of designs and material constructions exist for the cleaning filament 12. Stainless steel, nylon and plastic are all ideal materials with which to construct the cleaning filament 12, both alone and in combination with one another, although it is envisioned that a variety of alternative materials available from the plastics and textile industries would be equally suited.

As shown in FIG. 2, a flayed cleaning filament 15 consists of a single strand of filament material having a flayed filament body 16 with a series of generally pointed flays 17 protruding longitudinally therefrom along its entire length, arranged 360 degrees about its circumference. The flays 17 are created by cutting into a solid strand of filament material (not shown) at an acute angle, such that a pointed contour results, at various locations along its length and about its circumference.

As shown in FIG. 3, a bristled cleaning filament 20 consists of a single strand of filament material having a bristled filament body 21 with a series of bristles 22, protruding in a direction generally perpendicular to the longitudinal axis of the bristled filament body 21, spaced along its entire length and arranged 360 degrees about its circumference. The bristled filament body 21 consists of twisted or braided stainless wires (not shown) with the stainless steel, plastic, or nylon bristles 22 interwoven at various positions along its length and oriented at varying angles with respect to one another while maintaining a generally perpendicular orientation with the longitudinal axis of the bristled filament body 21.

As shown in FIG. 4, a scaled cleaning filament 25 consists of a single strand of filament material having a scaled filament body 26 with a series of generally rounded scales 27 protruding longitudinally therefrom along its entire length, arranged 360 degrees about its circumference. The scales 27 are created by cutting into a solid strand of filament material at an acute angle, such that a rounded contour results, at various locations along its length and about its circumference.

Figure 6:
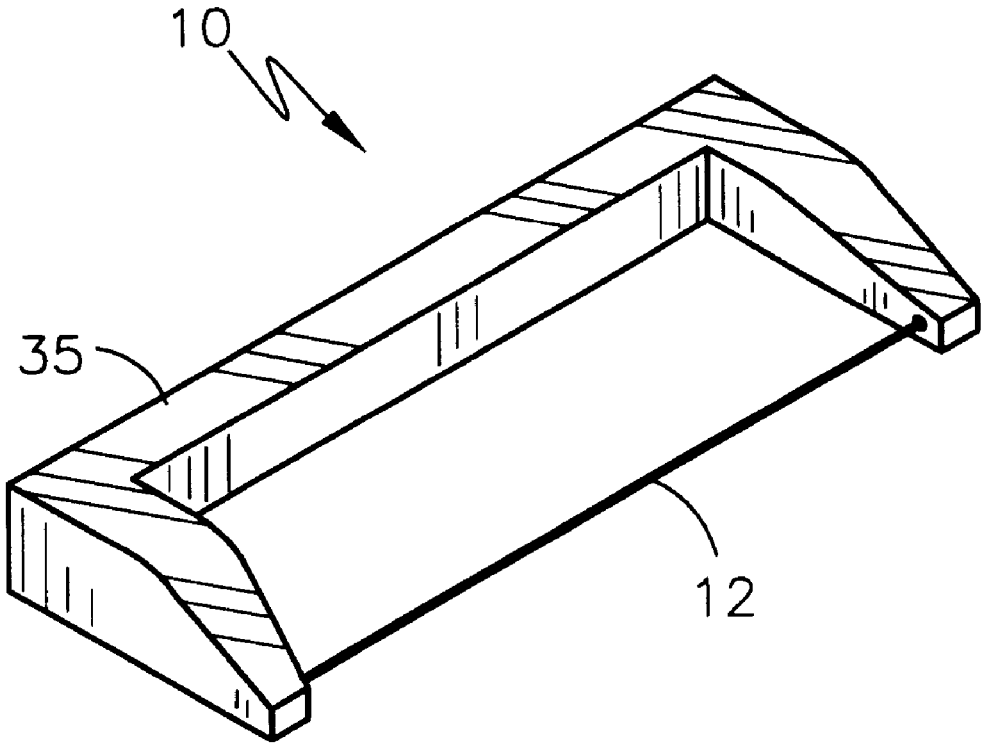
FIG. 6 is a front view of the filament cleaning tool for fingernails, according an alternate embodiment of the present invention.

Referring now to FIG. 6, depicted is the cleaning tool 10, according to an alternate embodiment of the present invention. In this embodiment, the cleaning filament 12 is of a pulled taught between a handle 35 of a rigid nature such that it can be grasped by a handle 35 and used in a manner similar to that of a conventional nail file or other nail cleaning implement. The cleaning filament 12 incorporated into the alternate embodiment assumes the varying designs of those depicted in FIGS. 2–4. The differences of this alternate embodiment the replacement of the finger rings with an elongated, rigid handle with the filament being drawn across. In this manner the filament can be drawn back and forth with the opposing hand in a manner similar to that of the preferred embodiment.

The aforementioned cleaning filament designs are by way of example and not of limitation as it is envisioned that a variety of alternative cleaning filament designs could be equally as effective. For example, a braided or twisted filament alone could be used effectively, or a solid strand filament could be distorted along its length, using a rolling die or the like to create a wide variety of cleaning filament configurations.

2. Operation of the Preferred Embodiment

Figure 5:
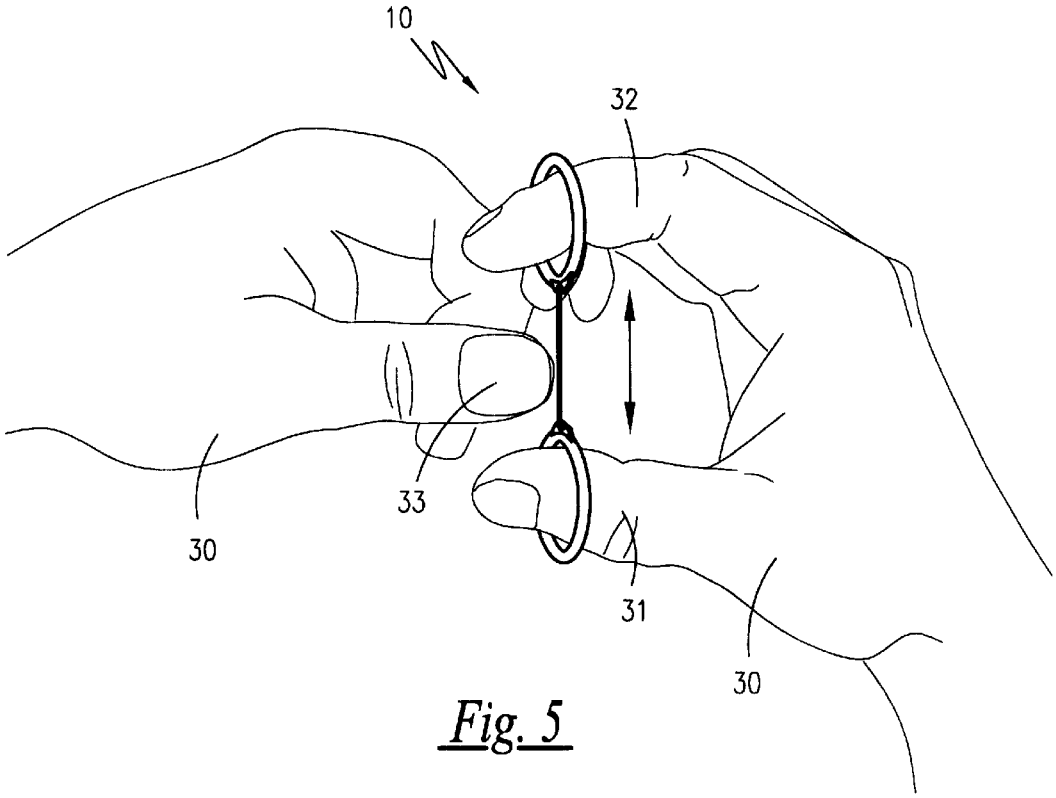
FIG. 5 is a perspective view of the filament cleaning tool for fingernails depicting its use in accordance with the preferred embodiment of the present invention.

In accordance with the preferred embodiment of the present invention and as shown in FIG. 5, the cleaning tool 10 is used in the following manner to remove dirt, grease and grime from beneath the fingernails:

The user would first wash his or her hands 30, applying a generous amount of soap and lather (not shown). Without rinsing the soap from the hands, the user would then secure the cleaning tool 10 to one hand 30 by placing a securing ring 11 over the thumb 31 and forefinger 32, respectively. Drawing the cleaning filament 12 taut, the user then inserts the cleaning filament 12 underneath the fingernail 33 on the hand opposite that of the cleaning tool 10, between the nail and the skin, and draws it along in a back and forth motion generally parallel to the edge of the fingernail 33. The flays 17, bristles 22 or scales 27, depending on the particular cleaning filament 12 configuration, create an abrasive force that serves to remove the material impacted beneath the fingernail 33. The soap lather enhances the effectiveness of the cleaning tool 10. By altering slightly the depth at which the cleaning filament 12 is inserted, the entire area underneath the fingernail 33 can be cleansed. This procedure is carried out on all of the affected fingernails 33 and, when done, the user simply rinses the cleaning tool 10 clean and stores it for future use.

In the alternate embodiment, the follows the same basic procedures as that of the preferred embodiment, taking into account that the accommodations for a flexible cleaning filament 12 are not required. Grasping the cleaning tool 10 by the handle 35, the user can insert the cleaning filament 12 beneath the nail, forcing it back and forth in order to remove dirt and grime.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A fingernail cleaning filament tool used to remove impacted dirt, grease and grime from beneath the fingernails, said filament tool comprising:

a cleaning filament having a first end opposite a second end, said cleaning filament being a flexible strand having a series of dirt removal means disposed along its length, wherein said dirt removal means further comprises a series of bristles disposed along the length of said cleaning filament, said flays comprising wire protrusions extending outward in a direction generally perpendicular to the longitudinal axis of said cleaning filaments;

first and second securing rings of a generally rigid construction and having a filament securing means incorporated therein, said first end secured to said first securing ring via a filament securing means and said second end secured to said second securing ring via a filament securing means;

wherein said cleaning filament is supported by said securing rings and inserted longitudinally beneath a fingernail and drawn back and forth linearly along the longitudinal axis of said cleaning filament, said dirt removal means dislodging and removing dirt deposits therefrom.

2. The filament tool of claim 1, wherein said dirt removal means further comprises a series of flays disposed along the length of said cleaning filament, said flays comprising generally pointed protrusions extending outward at an acute angle.

3. A fingernail cleaning filament tool used to remove impacted dirt, grease and grime from beneath the fingernails, said filament tool comprising:

a cleaning filament having a first end opposite a second end, said cleaning filament being a generally rigid rod having a series of dirt removal means disposed along its length, wherein said dirt removal means further comprises a series of bristles disposed along the length of said cleaning filament forming flays, said flays comprising wire protrusions extending outward in a direction generally perpendicular to the longitudinal axis of said cleaning filament; and a securing handle attached to said first end;

wherein said cleaning filament is supported by said securing handle and inserted longitudinally beneath a fingernail and drawn back and forth linearly along the longitudinal axis of said cleaning filament, said dirt removal means dislodging and removing dirt deposits therefrom.

4. A fingernail cleaning filament tool used to remove impacted dirt, grease and grime from beneath the fingernails, said filament tool comprising:

a cleaning filament having a first end opposite a second end, said cleaning filament being a flexible strand having a series of dirt removal means disposed along its length, wherein said dirt removal means further comprises a series of bristles disposed along the length of said cleaning filament, said bristles comprising wire protrusions extending outward in a direction generally perpendicular to the longitudinal axis of said cleaning filament;

a handle of a generally rigid construction and having a first and second filament securing means incorporated therein, said first end secured to said first filament securing means and said second end secured to said filament securing means;

wherein said cleaning filament is supported by said securing rings and inserted longitudinally beneath a fingernail and drawn back and forth linearly along the longitudinal axis of said cleaning filament, said dirt removal means dislodging and removing dirt deposits therefrom.

* * * * *